US006354518B1

(12) United States Patent
Gil et al.

(10) Patent No.: US 6,354,518 B1
(45) Date of Patent: Mar. 12, 2002

(54) PRESSURE ACTUATED SHOWER HEAD MECHANISM

(75) Inventors: Amos Gil, Farmington Hills, MI (US); Ben Ami, Haifa (IL)

(73) Assignee: Brass-Craft Manufacturing Company, Novi, MI (US)

( * ) Notice: Subject to any disclaimer, the term of this patent is extended or adjusted under 35 U.S.C. 154(b) by 0 days.

(21) Appl. No.: 09/572,184

(22) Filed: May 17, 2000

Related U.S. Application Data

(60) Division of application No. 09/082,990, filed on May 22, 1998, now abandoned, which is a continuation-in-part of application No. 08/999,326, filed on Dec. 29, 1997, now Pat. No. 6,170,765.

(51) Int. Cl.[7] ..... B05B 1/32

(52) U.S. Cl. ..... 239/458; 460/505; 460/514; 460/562

(58) Field of Search ..... 239/451, 456, 239/457, 458, 460, 537, 539, 541, 514, 498, 548, 562, 579, 524, 533.1, 505, 507

(56) References Cited

U.S. PATENT DOCUMENTS

| | | | | | |
|---|---|---|---|---|---|
| 1,337,516 | A | * | 4/1920 | Holmes et al. | 239/562 X |
| 3,116,880 | A | * | 1/1964 | Kuiken | 239/524 X |
| 3,130,919 | A | * | 4/1964 | Baker | 239/458 X |
| 3,189,284 | A | * | 6/1965 | Downey | 239/460 |
| 3,383,051 | A | * | 5/1968 | Fiorentino | 239/460 |
| 3,995,812 | A | * | 12/1976 | Anderson | 239/562 X |
| 4,273,289 | A | * | 6/1981 | Jette | 239/458 |

* cited by examiner

*Primary Examiner*—Steven J. Ganey
(74) *Attorney, Agent, or Firm*—Edgar A. Zarins; Lloyd D. Doigan

(57) ABSTRACT

A shower head having a water inlet passage or providing a supply of water to the shower head and a plurality of nozzles for expelling water from the shower head. The flow of water from the water inlet passage to the nozzles is controlled by a pressure actuated toggle valve mechanism. The valve mechanism is in communication with a rotatable faceplate used to control both the water flow and the texture of the shower spray. The faceplate is rotatably adjustable over a plurality of discrete positions to vary the spray between a coarse and fine shower spray.

11 Claims, 6 Drawing Sheets

PRESSURE ACTUATED SHOWER HEAD MECHANISM

This application is a divisional of U.S. patent application Ser. No. 09/082,990 filed on May 22, 1998, now abandoned, which is a continuation-in-part of U.S. patent application Ser. No. 08/999,326 filed on Dec. 29, 1997, now U.S. Pat. No. 6,170,765 issued on Jan. 9, 2001.

TECHNICAL FIELD

The present invention relates to a design for a shower head. More particularly, the present invention relates to a shower head that allows for the turning on and shutting off of water flow through the shower head as well as adjustment of the water spray through simple rotation of a face plate.

BACKGROUND ART

Standard shower head assemblies are known in the art that have an adjustment ring that can be turned to vary the type and amount of water flow from the shower head. The ring can vary the volume of water flowing through the shower head and can switch the shower head between different spray modes, for instance concentrating flow from a single central large diameter orifice or from an array of peripheral small-diameter orifices or nozzles.

Numerous other shower head assemblies are known in the art that can be adjusted to discharge a continuous spray or a pulsating spray. Typical of such shower heads are those disclosed in U.S. Pat. Nos. 3,801,019, 4,068,801, and 4,254,914. U.S. Pat. No. 3,801,019 for example, discloses a spray nozzle capable of delivering both a spray of water and pulsating water, and employing three sets of flow passages. Control of the frequency of pulsation or the apportionment of spray through the flow passages is accomplished by adjusting a shuttered plate relative to a flow directing plate.

In addition to adjusting the rate of water flow through the shower head, the coarseness of the spray pattern can also be adjusted in many showerheads. However, in many prior known shower heads, the flow rate and spray are independently adjusted through different valving mechanisms requiring independent adjustment of the flow and spray.

DISCLOSURE OF THE INVENTION

It is an object of the present invention to provide a shower head with a toggle valve mechanism that is resistant to water deposit build up.

It is another object of the present invention to provide a toggle valve mechanism that is less complex than prior mechanisms and requires less moving parts.

It is still another object of the present invention to provide a simple valve mechanism that allows for the manipulation of the shower head to vary the flow of water through the outlet orifices.

It is still a further object of the present invention to provide a toggle valve and variable flow mechanism that operates based on the water pressure present in the shower head.

It is yet a further object of the present invention to provide a toggle valve that allows the water flow to be shut-off or varied and is kept in its desired place by the water pressure in the shower head without the need for any other securing mechanism.

It is a still further object of the present invention to provide a simple valve mechanism controlled through the faceplate of the shower head for adjustment of the flow rate and water spray.

In accordance with the objects of the present invention a shower head with an inlet passage is provided. The inlet passage is connected to a water source to provide a water supply to the shower head body. The shower head body is partitioned into an upper half and a lower half with a fluid channel connecting the upper half of the shower head body with the lower half of the shower head body. The lower half of the shower head has a plurality of fluid nozzles formed in its bottom surface for expelling water from the shower head. The fluid channel includes a toggle valve mechanism that helps regulate the amount of water flowing from the upper half of the shower head body to the lower half of the shower head body. The lower half of the shower head body is rotatable and is in communication with the pressure actuated valve mechanism such that rotation of the lower half of the shower head body will vary the amount of water flowing through the mechanism. The toggle valve mechanism is pressure actuated in that once it is set in place such that the desired flow through the shower head is achieved, the water pressure from the water source retains the toggle valve mechanism in that position thus preventing further movement.

In one preferred embodiment, the toggle valve mechanism includes a turn key having a top portion and a stem. The stem of the turn key extends through the fluid channel and into contact with the lower half of the shower head body. The top portion of the turn key has an underside that contacts and is slidable upon a ridge portion in the fluid channel. The ridge portion has a pair of opposing grooves or detents formed in its surface for mating engagement with the turn key. When the turn key is in a non-mating relationship with the grooves, the valve mechanism is open and water is allowed to flow from the upper half of the shower head body to the lower half of the shower head body through the fluid channel. When the turn key is in a mating relationship with the grooves, the valve mechanism is closed preventing the flow of water from the upper half of the shower head body to the lower half of the shower head body.

The present invention also facilitates simple control of the spray emanating from the shower head through adjustment of a rotatable faceplate. The faceplate is connected to the toggle valve mechanism such that rotation of the faceplate is transmitted to the valve to move the turn key along the ridge portion thereby opening and closing the valve. A diverter member disposed between the faceplate and toggle valve directs the fluid flow radially outwardly along arcuate grooves formed in an outer housing. The diverter moves axially in conjunction with the toggle valve to alter the water spray between a fine spray and a coarse spray. The arcuate grooves in the outer housing are in direct communication with openings in the face plate to direct the fluid flow out of the showerhead.

While an embodiment of this invention is illustrated and disclosed, this embodiment should not be construed to limit the claims. It is anticipated that various modifications and alternative designs may be made without departing from the scope of the invention.

DESCRIPTION OF THE DRAWINGS

The present invention will be more fully understood by reference to the following detailed description of a preferred embodiment of the present invention when read in conjunction with the accompanying drawing, in which like reference characters refer to like parts throughout the view and in which.

DETAILED DESCRIPTION OF THE INVENTION

Figure 1:
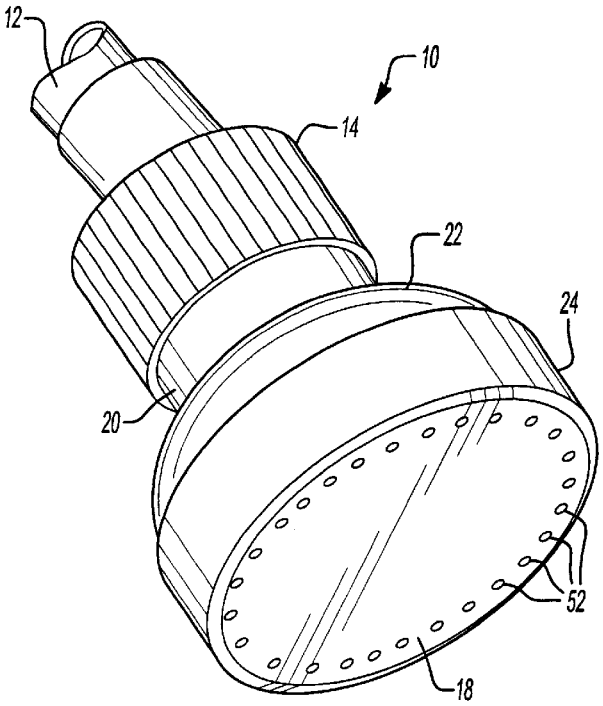
FIG. 1 is a perspective view of a shower head assembly in accordance with the present invention.

FIGS. 1 through 5 illustrate a shower head in accordance with a preferred embodiment of the present invention. The shower head 10 is connected to a water source (not shown) by a water input line 12. The shower head 10 is connected to the water input line 12 by a connector 14, of the type which is well known in the art. The connector 14 allows the shower head 10 to be manipulated through a variety of positions. It should be understood that the shower head 10 may be permanently attached to a shower wall or may be of the hand held type that can be removed from the shower wall. Also, other types of connections between the water input line 12 and the shower head 10 can be employed. The shower head 10 is preferably constructed of a plastic material but may be formed of other known materials.

The shower head 10 has a top surface 16, a bottom surface 18, a generally cylindrical neck portion 20, a generally bell-shaped bottom portion 22, and a circular rotating portion 24 that terminates in the bottom surface 18. The directional terms such as "up", "down", "top", and "bottom" are used herein for orientation purposes only with respect to the figures and are not intended to refer to the shower head as it is oriented in use or as it is mounted in a shower.

Figure 2:
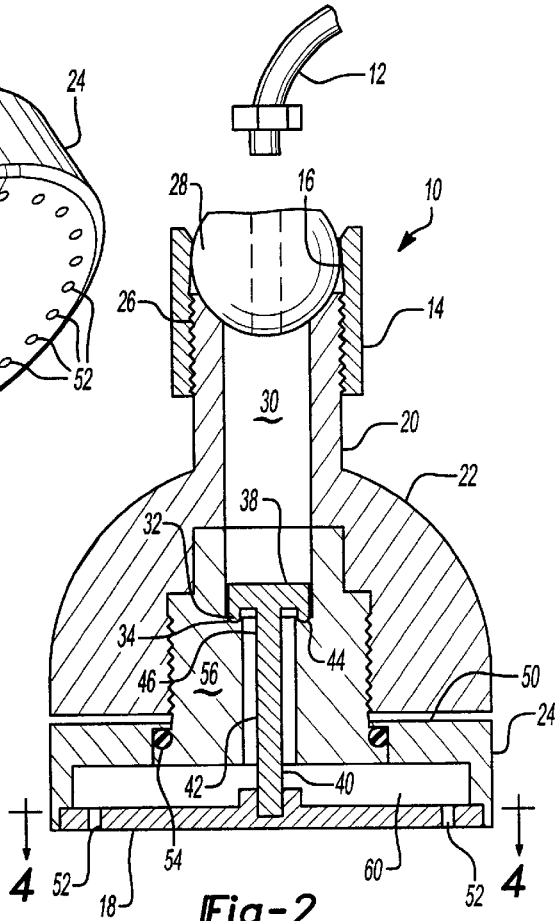
FIG. 2 is a cross-sectional view of a shower head assembly in accordance with a preferred embodiment of the present invention.
Figure 3:
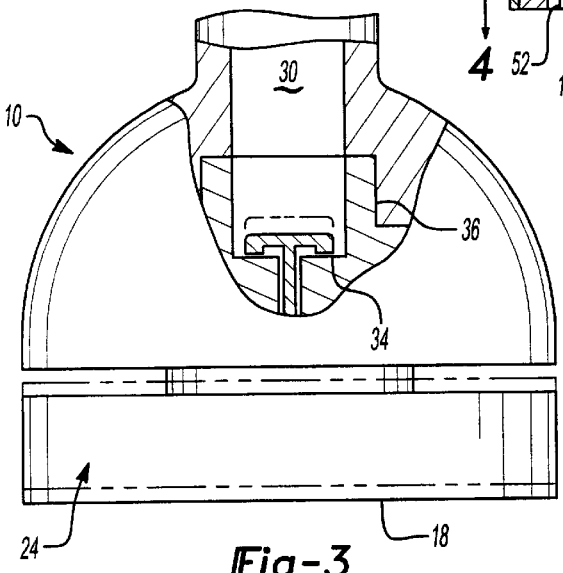
FIG. 3 is a side view broken away illustrating the toggle valve mechanism in accordance with the present invention.
Figure 4:
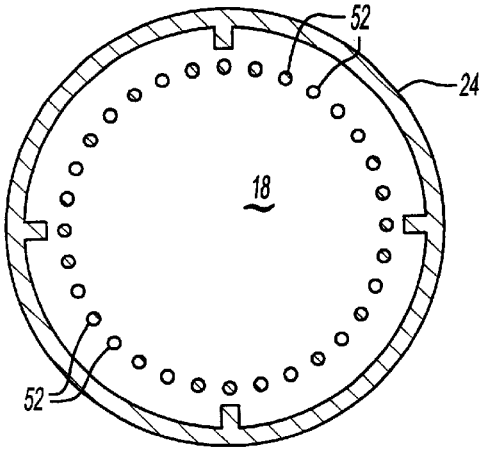
FIG. 4 is a bottom plan view of a shower head in accordance with a preferred embodiment of the present invention.
Figure 5:
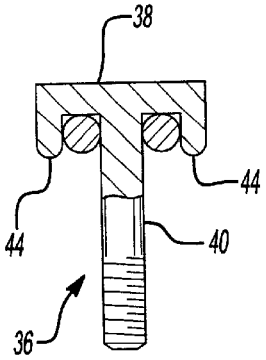
FIG. 5 is a side view of a portion of one preferred toggle valve mechanism in accordance with the present invention.

As shown in FIG. 2, the connector 14 has a plurality of threads 26 that secure the connector 14 to the generally cylindrical neck portion 20. In the preferred embodiment, threads are located on both the neck portion 20 and the connector 14. The attachment of the connector 14 to the generally cylindrical neck portion 20 allows water from the water inlet line 12 to flow into fluid passage 30 through a shower ball or opening 28. The connector 14 not only places the shower head body 10 in fluid communication with the water inlet line 12, but it also provides a leak free connection, to prevent water from leaking at the joint where the shower head 10 and water inlet line 12 are attached.

The shower head body 10 has a fluid passage 30 formed therein that receives the water after it passes through the shower ball 28 in the top surface 16 of the shower head body 10. The fluid passage 30 is defined by the top surface 16 and a ridge or shoulder portion 32. The ridge portion 32 has at least one groove or detent 34 formed therein. The ridge portion 32 is preferably flat or parallel with respect to the top surface 16 of the shower head body 10, but may alternatively be inclined or cammed.

A valve mechanism 36 is preferably disposed within the fluid passage 30. The valve mechanism 30 includes a top portion 38 and a stem 40. The top portion 38 of the valve mechanism 36 is generally rectangular in shape, but may alternatively be another shape, including circular or triangular. The top portion 38, must however fit within the fluid passage 30 and be of a size and shape to allow water from the fluid passage 30 to pass thereby into an internal passage 42.

The top portion 38 of the valve mechanism 36 has an underside upon which at least one protrusion 44 is formed. In the preferred embodiment, two protrusions 44 are present and they are formed on either side of the top portion 38. The protrusions 44 are designed to contact the surface 34 which is a helical surface such that when the protrusions 44 are contacting the lowest portion of the helix, (FIG. 3) the flow of water is prevented from flowing from the fluid passage 30 to the internal passageway 42. The grooves 34 preferably have opposing sides 46. The opposing sides 46 are generally divergent from the bottom of the grooves 34 to allow the protrusions 44 to easily engage and disengage the grooves 34.

The stem 40 of the valve mechanism 36 extends downwardly through the internal passageway 42 and is secured to the bottom surface 18 of the circular rotating portion 24. The circular rotating portion 24 is not secured to the remainder of the shower head body 10 and has a bottom surface 18, a circular periphery 48, and a top portion 50. The circular rotating portion 24 defines a water chamber 60 therein which receives and houses water passed through the internal passageway 12 before it exits the orifices 52. An annular seal 45 (FIG. 5) is located on the undersurface of the top portion 38 of the valve mechanism 36 to seal the fluid passage 30 from the internal passage 43.

The bottom surface 18 has a plurality of water orifices or nozzles 52 formed about its periphery. As the stem 40 is connected to the circular rotating portion 24, the top portion 38 of the valve mechanism 36 rotates as the circular rotating portion 24 is rotated. An O-ring 54 is interposed between the top portion 50 and an internal flange 56 that extends below the bell-shaped body 20 and surrounds the internal passage 42. This connection keeps the circular rotating portion 24 in contact with the shower head body 10, but allows it to rotate freely.

In operation, as the circular rotating portion 24 is rotated (either clockwise or counter-clockwise) the valve mechanism 36 is caused to rotate in the same direction. As the valve mechanism 36 is rotated, the helical or cam surface 34 causes the valve mechanism 36 to move away from the internal flange 56, allowing water to flow. When the valve mechanism 36 is in the lowest position relative to the internal flange 56, the flow of water from the inlet pipe 12 is shut off and no water flows through the internal passage 42, into the water chamber 60, and out the nozzles 52. The valve mechanism 36 is kept in place in the grooves 34 by the water pressure. It should be understood that the term shut-off is not intended to mean 100% or complete stoppage of water flow. This because it is often desirable to have a trickle in the shut-off position.

When the valve mechanism 36 is rotated such that the valve mechanism moves away from the internal flange 56, water is allowed to pass through the internal passage 42, into the water chamber 60, and out the plurality of nozzles 52. Again, the valve mechanism 36 is held in position by the water pressure in the shower head body 10. The profile of surface 32 may be varied such that the distance between the top portion 38 of the valve mechanism 36 and the internal passage 42 is adjustable. Thus, the amount of water that will flow through the passage is adjustable.

Figure 6:
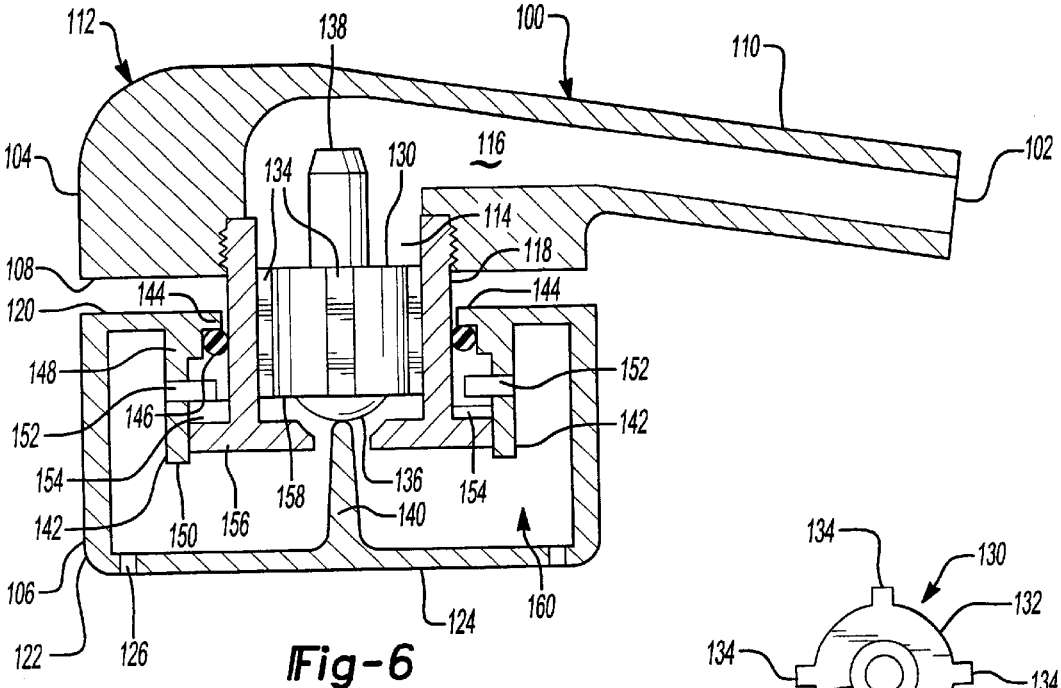
FIG. 6 is a cross-sectional view of a shower head assembly in accordance with another preferred embodiment of the present invention.
Figure 7:
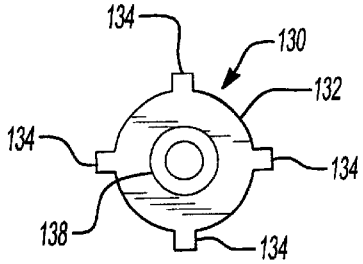
FIG. 7 is a top view of the toggle valve mechanism shown in FIG. 6.
Figure 8:
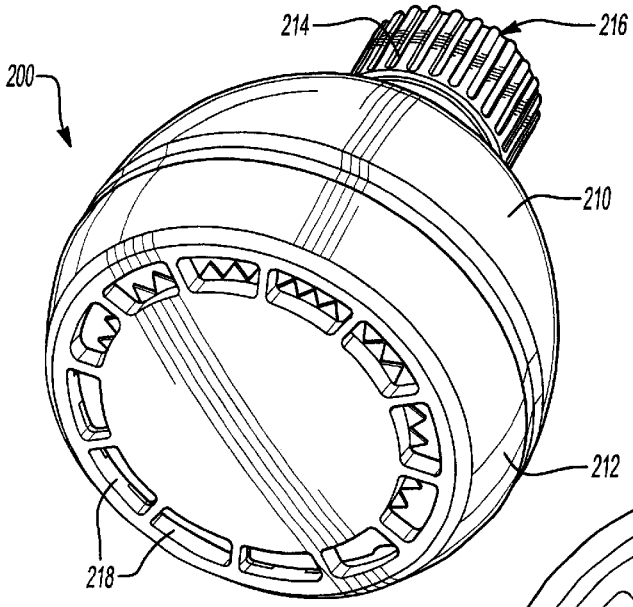
FIG. 8 is a perspective view of an alternative embodiment of the shower head.
Figure 9:
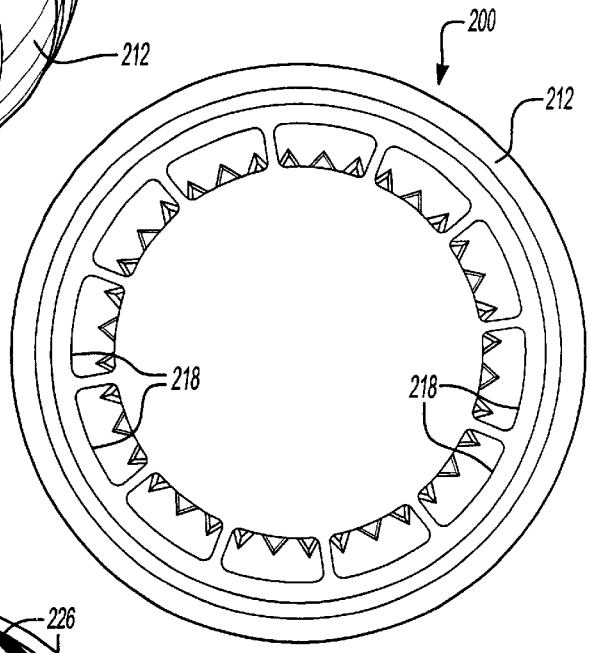
FIG. 9 is a face view of the shower head.
Figure 10:
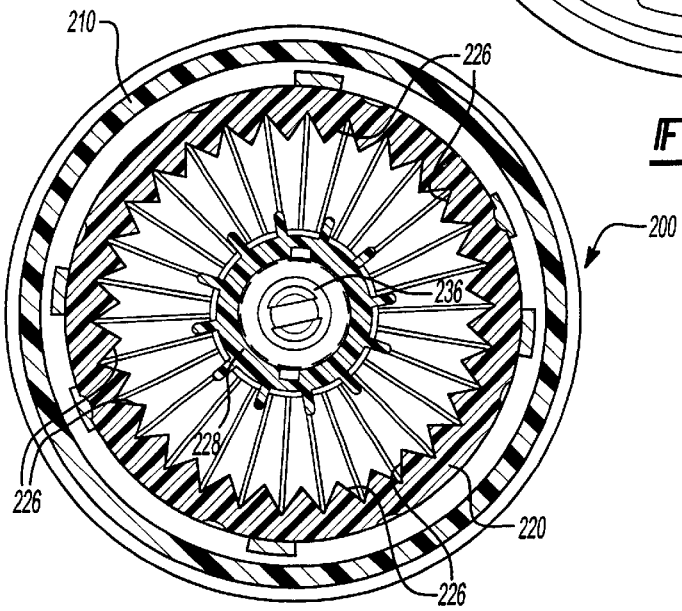
FIG. 10 is a transverse cross-sectional view taken along lines 10—10 of FIG. 11.

Turning now to FIGS. 6 and 7 which illustrates another preferred embodiment of the present invention. As shown in FIG. 6, the shower head 100 is connected to a water input line 102. The shower head 100 has an upper portion 104 and a lower portion 106, with the upper portion 104 being connected to the water input line 102. The upper portion 104 has a generally planar bottom surface 108, a neck portion 110 which is connected to the water input line 102, and a semi-spherical portion 112. The upper portion 104 and the lower portion 106 are each preferably one-piece integrally molded pieces.

The upper portion 104 has a generally cylindrical passage 114 formed in its bottom surface 108. The cylindrical passage 114 is in fluid communication with the water input line 102 by a water passage 116 formed in the neck portion 110 and the semi-spherical portion 112. A retainer 118 is attached to the outer surface of the generally cylindrical passage 114 by grooves, teeth or other known apparatus for attachment. The lower portion 106 has a top surface 120 through which the retainer 118 is received, a generally circular periphery 122, and a bottom surface 124, through which a plurality of spray nozzles 126 or orifices are formed.

A valve mechanism 130 is preferably disposed within the cylindrical passage 114. As shown in FIG. 7, the valve mechanism 130 includes a generally cylindrical body portion 132, a plurality of rib portions 134 formed on the surface of the generally cylindrical body portion 132, a rounded bottom portion 136, and a stop member 138 that extends from the generally cylindrical body portion 132. The diameter of the generally cylindrical body portion 132 is less than the retainer 118 in which it sits. Additionally, the diameter of the valve mechanism 130 as measured from its outermost portion (the tip of the ribs 134) is also less than the inner diameter of the retainer 118. This allows the valve mechanism 130 to move freely within the retainer 118. However, the diameter of the ribs 134 must not be so small as to allow the valve mechanism 130 to rotate about a horizontal axis and block the flow of water from the water inlet line 102.

The rounded bottom portion 136 rests on a finger 140 extending upwardly from the bottom surface 124 of the lower portion 106 of the shower head 100. The lower portion 106 is rotatable to adjust the flow of water that exits the plurality of nozzles 126 until the flow of water is shut off completely.

The lower portion 106 has an opening through which the retainer 118 is received. The opening is defined by a downwardly extending ring portion 142 and a projection portion 144. The projection portion 144 extends towards the retainer 118 and contacts an O-ring 146 positioned beneath the projection portion 144. The O-ring 146 is bounded on its top by the projection portion 142 of the lower portion 106, on its inner side by the outer surface of the retainer 118 and on its outer surface by the upper portion 148 of the downwardly extending ring portion 142.

The lower portion 150 of the downwardly extending ring portion 142 has a pair of pins 152 extending outwardly therefrom. It should be understood that more or less pins 152 may be utilized. The pins 152 extend into contact with a cam surface 154 located on a bottom portion 156 of the retainer 118. As the lower portion 106 of the shower head 100 is rotated, the pins 152 rotate along the cam surface 154 and adjust the height of the finger 140 and thus the height of the valve mechanism 130 within the retainer 118. When the pins 152 are at the lowest point of the cam surface 134, the valve mechanism 130 is positioned in the retainer 118 to shut off the flow of water from the water supply line 102.

When in the closed or shut off position, the bottom surface 158 of the valve mechanism 130 contacts the bottom portion 156 of the retainer 118 that extends into the opening. By rotation of the lower portion 106, the valve mechanism 130 is lifted upwards by the finger 140 and water is allowed to travel from the cylindrical passage 114 into the lower portion 106 of the shower head 100. The lower portion 106 includes a water chamber 160 in which water is housed before it is expelled from the plurality of spray nozzles 126. The upward movement of the valve mechanism 130 is limited by the stop member 138 extending generally upward therefrom.

While the valve mechanism is not permanently affixed to any component, it is maintained in a shutoff position by water pressure in the cylindrical passageway 114. Thus, the valve mechanism 130 will not become unseated from the shoulder portions 156 and allow water to flow into the lower portion 106 of the shower body 100. Additionally, a plurality of grooves (not shown) can be formed into the cam surface 154 to effectuate the shut-off of water flow.

FIGS. 8 through 13 disclose an alternative embodiment of the shower head 200 incorporating the valve mechanism 236 for controlling the flow of water through the shower head 200. The shower head 200 generally incorporates a bell-shaped housing 210, a selectively rotatable faceplate 212 and a pivotable neck 214 for attaching the shower head to an arm of the shower (not shown) while allowing positional adjustment. Water entering the shower head 200 through an inlet passageway 216 of the neck 214 flows out of apertures 218 in the faceplate 212.

Referring now to FIGS. 10 through 13, which show cross-sectional views of the shower head 200, disposed within the housing 210 is a flow chamber 220 which directs fluid flow from the inlet 216 to the apertures 218. The flow chamber 220 is preferably threadably connected to the housing 210 and includes a dome shaped chamber 222. A central aperture 224 in the flow chamber 220 receives the valve mechanism 236 to control fluid flow. The interior surface of the domed chamber 222 includes a plurality of grooves 226. As has been described herein, the valve mechanism 236 is manipulated to control the flow of water through the aperture 224 and the domed chamber 222.

The faceplate 212 is operatively connected to a diverter member 228 which is connected to the valve mechanism 236 such that rotation of the face plate 212 is transmitted to the valve mechanism 236 in accordance with the previously described embodiments of the present invention. The diverter member 228 has an axial seat 230 for receiving the valve 236 and a radially extending peripheral flange 232. The diverter member 228 is reciprocally seated within an axial cavity 234 of the faceplate 212. Water flowing through the aperture 224 is directed radially outwardly by the diverter 228, flows along the grooves 226, and out the apertures 218 of the faceplate 212 in accordance with the operation of the shower head.

Figure 11:
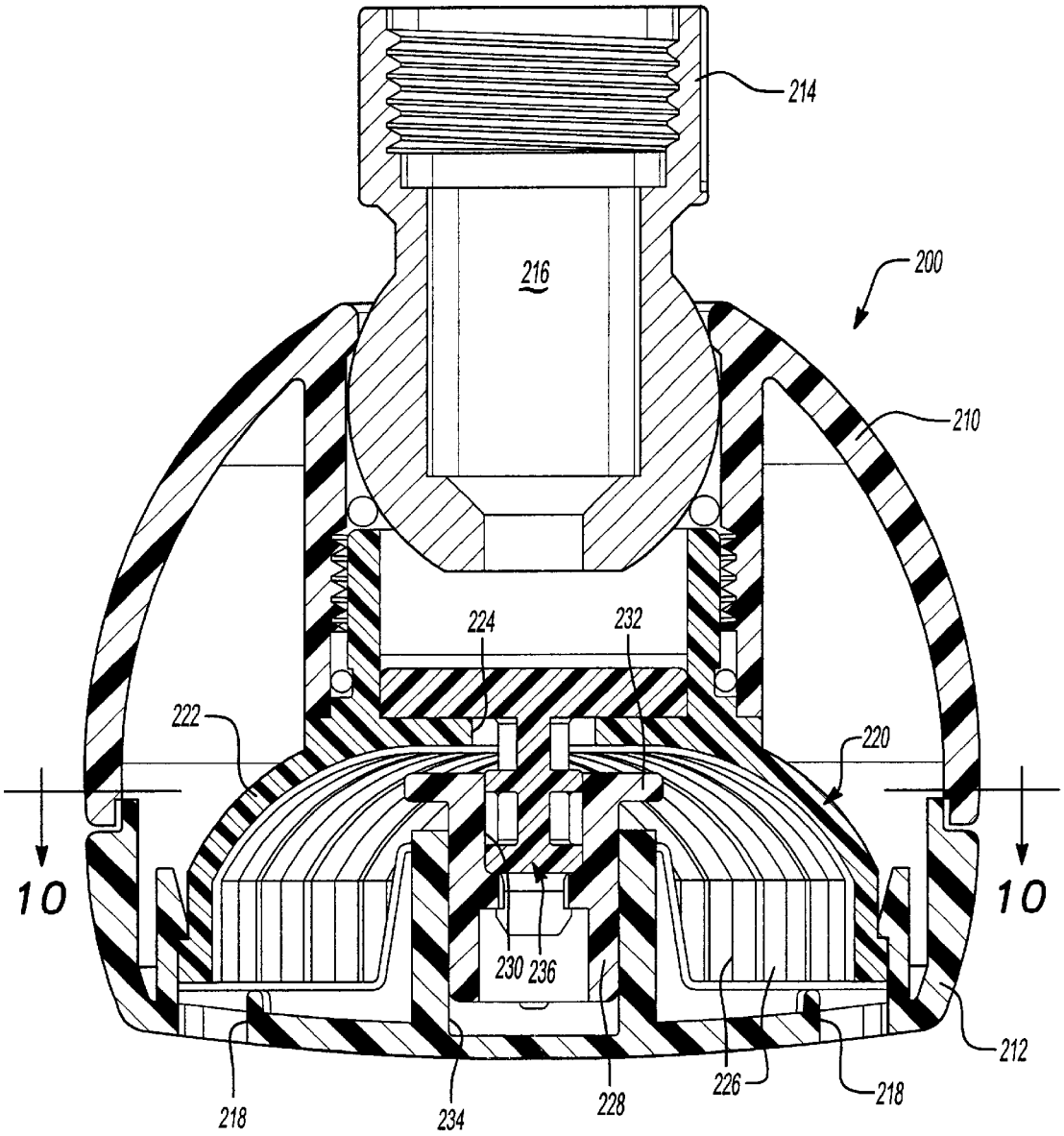
FIG. 11 is a cross-sectional view of the shower head with the valve mechanism in a first position.
Figure 12:
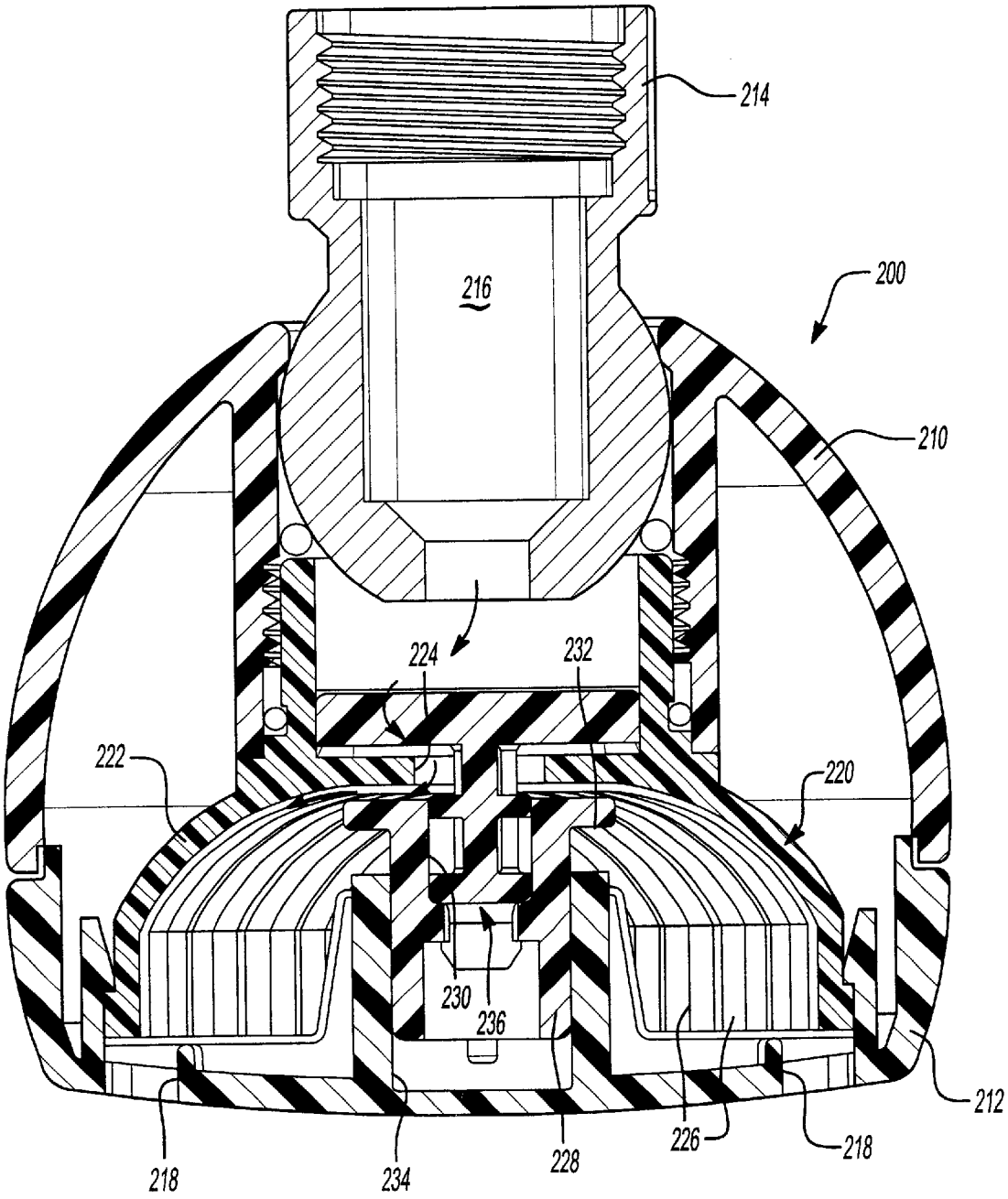
FIG. 12 is a cross-sectional view of the shower head with the valve mechanism in a second position.
Figure 13:
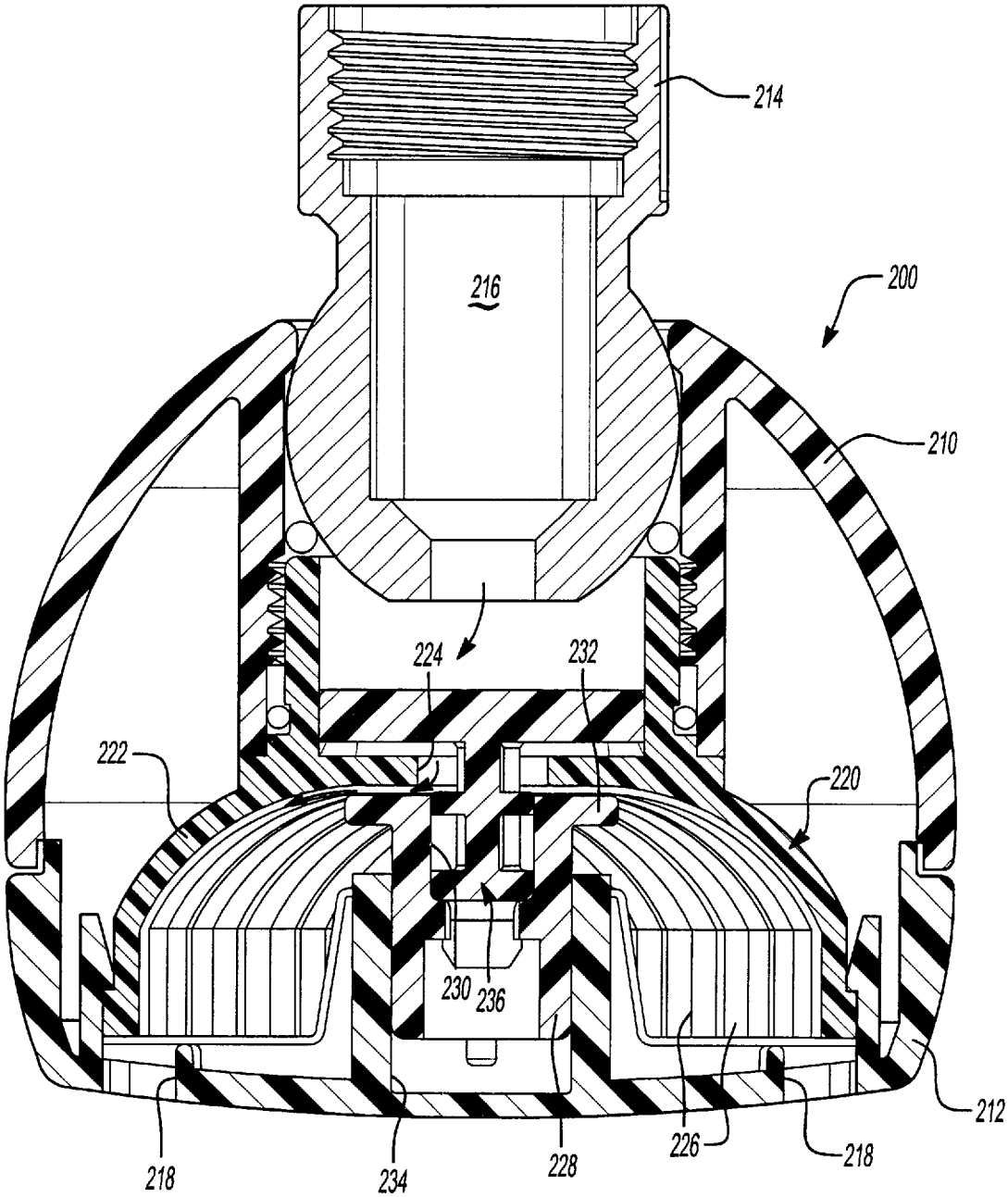
FIG. 13 is a cross-sectional view of the shower head with the valve mechanism in a third position.

The texture or coarseness of the water spray emanating from the shower head 200 is adjusted through manipulation of the faceplate 212 to adjust the flow past the valve mechanism 236 and the diverter 228 as will be subsequently described. The faceplate 212 is rotatably adjustable along a plurality of discrete positions in turn rotating the valve mechanism 236 between an open and closed position. Simultaneously, the position of the diverter 228 is axially adjusted relative to the aperture 224 to alter the spray texture between a fine spray and a coarse spray. The faceplate 212 is adjustable along discrete positions to ensure alignment of the apertures 218 of the faceplate with appropriate zones of the grooves 226 to prevent disruption of the flow from the shower head. FIG. 11 illustrates the shower head 200 in the shut-off position with the valve mechanism 236 closed preventing flow through the aperture 224. Rotation of the faceplate 212 in a first direction will cause the valve mechanism 236 to raise away from the aperture 224 (FIG. 12) creating a coarse spray texture as the water flows past the diverter 228, along the grooves 226 and out the apertures 218. Continued rotation of the faceplate 212 will move the diverter 228 closer to the aperture (FIG. 13) creating an increasingly finer spray texture.

Thus, the shower head 200 of the present invention provides a simple and convenient mechanism for controlling or adjusting not only the flow of water but also the texture of the spray through manipulation of the faceplate 212 on the shower head 200. Accordingly, in addition to controlling the water flow at its source, preferably a wall-mounted valving mechanism, the shower head 200 allows the user full control of the shower spray at the shower head 200. The discrete positions of the faceplate 212 ensures that the spray is not disrupted as it flows from the shower head.

While embodiments of the invention have been illustrated and described, it is not intended that such disclosure illustrate and describe all possible forms of the invention. It is intended that the following claims cover all modifications and alternative designs, and all equivalents, that fall within the spirit and scope of this invention.

What is claimed is:

1. A shower head comprising:

a housing having a body, a water chamber and a rotatable face portion including a plurality of fluid apertures;

a water inlet line providing a source of water to said shower head;

a fluid passageway formed in said shower head allowing water to flow from said water inlet line to said water chamber; and a valve mechanism located within said fluid passageway and a diverter member operably connected to said valve mechanism and said rotatable face portion, said diverter member including at least one radial flange selectively cooperable with said fluid passageway whereby rotation of said face portion longitudinally adjusts said valve mechanism and diverter member to regulate and alter the spray texture of the flow of water through said shower head.

2. The shower head of claim 1 wherein said face portion is rotatably adjustable along a plurality of discrete positions.

3. The shower head of claim 2 wherein said water chamber includes a plurality of grooves directing water flow from said fluid passageway through said shower face, said discrete positions of said rotatable face portion aligning said fluid apertures with said plurality of grooves.

4. The shower head of claim 3 wherein said water chamber has a semi-spherical configuration, said grooves formed in a chamber wall to direct said fluid flow to said fluid apertures.

5. A shower head comprising:

a housing having a body, a water chamber and a rotatable face portion including a plurality of fluid apertures;

a water inlet line providing a source of water to said shower head;

a fluid passageway formed in said shower head allowing water to flow from said water inlet line to said water chamber;

means for controlling the flow of water through said fluid passageway; and a diverter member operably connected to said rotatable face portion and said means for controlling the flow of water whereby rotation of said face portion and said means for controlling the flow of water adjusts said diverter member to alter the spray texture of the flow of water past said diverter member and through said shower head.

6. The shower head of claim 5 wherein said diverter member includes at least one radial flange selectively cooperating with said fluid passageway to alter the spray texture of the water flow through said face portion, said diverter member longitudinally adjustable upon rotation of said face portion thereby altering the spray texture of the water flow.

7. The shower head as defined in claim 6 wherein said face portion is rotatably adjustable along a plurality of discrete positions.

8. The shower head as defined in claim 7 wherein said water chamber includes a plurality of grooves directing water flow from said fluid passageway through said shower face, said discrete positions of said rotatable face portion aligning said fluid apertures with said plurality of grooves.

9. A shower head comprising:

a housing having a body, a water chamber and a rotatable face portion including a plurality of fluid apertures, said face portion rotatably adjustable along a plurality of discrete positions;

a water inlet line providing a source of water to said shower head;

a fluid passageway formed in said shower head allowing water to flow from said water inlet line to said water chamber; and a valve mechanism located within said fluid passageway and a diverter member operably connected to said valve mechanism and said rotatable face portion whereby rotation of said face portion longitudinally adjusts said valve mechanism and diverter member to regulate the flow of water through said shower head;

wherein said water chamber includes a plurality of grooves directing water flow from said fluid passageway through said shower face, said discrete positions of said rotatable face portion aligning said fluid apertures with said plurality of grooves.

10. The shower head of claim 9 wherein said water chamber has a semi-spherical configuration, said grooves formed in a chamber wall to divert said fluid flow to said fluid apertures.

11. The shower head of claim 9 wherein said diverter member includes at least one radial flange selectively cooperating with said fluid passageway to alter the spray texture of the water flow through said face portion.

* * * * *